United States Patent [19]

Chaney et al.

[11] 4,139,836

[45] Feb. 13, 1979

[54] WELLBORE INSTRUMENT HANGER

[75] Inventors: Preston E. Chaney, Dallas; H. Eugene Sharp, Houston, both of Tex.

[73] Assignee: Sperry-Sun, Inc., Sugar Land, Tex.

[21] Appl. No.: 812,168

[22] Filed: Jul. 1, 1977

[51] Int. Cl.[2] ..... G01V 1/40

[52] U.S. Cl. ..... 340/18 NC; 340/18 LD; 340/18 R; 166/208

[58] Field of Search ..... 340/18 NC, 18 R, 18 LD; 166/208

[56] References Cited

U.S. PATENT DOCUMENTS

| | | | |
|---|---|---|---|
| 2,345,888 | 4/1944 | Scott | 166/208 |
| 3,450,204 | 6/1969 | Brown et al. | 166/208 |
| 3,578,081 | 5/1971 | Bodine | 181/106 |
| 3,720,261 | 3/1973 | Heilhecker et al. | 166/208 |
| 3,737,843 | 6/1973 | Le Peuvedic et al. | 340/18 LD |
| 3,893,717 | 7/1975 | Nelson | 166/208 |
| 4,021,774 | 5/1977 | Asmundsson et al. | 340/18 R |

*Primary Examiner*—Howard A. Birmiel
*Attorney, Agent, or Firm*—Macka L. Murrah

[57] ABSTRACT

A sub for use in an acoustic telemetry system provides a sound path of low impedance to facilitate the transmission of acoustic signals through a string of pipe positioned in a wellbore. The sub section of pipe includes a tubular receiving member positioned in the bore of a pipe section and spaced from the interior walls thereof. Ports and flow channels are also provided to permit the passage of well fluids through the pipe section when an acoustic instrument is positioned in the tubular receiving member. A lateral shoulder is formed in the interior wall of the receiving member and is arranged to matingly receive a flat portion on the instrument. The abutment of the flat portion of the instrument and the shoulder provides a positive sound path for transmission of longitudinal sound waves from the instrument to the receiver member. The receiver member in turn is connected to the pipe section by longitudinal portions essentially concentric with the axis of the pipe section so as to provide a direct low impedance sound path for the efficient direct transmission of longitudinal sound waves.

13 Claims, 4 Drawing Figures

WELLBORE INSTRUMENT HANGER

BACKGROUND OF THE INVENTION

This invention relates to an instrument hanger sub and, more particularly, to a pipe sub for receiving an acoustic instrument and positioning the instrument in a string of pipe in a manner affecting the efficient transmission of longitudinal sound waves in the pipe string for use in a borehole. The present invention results from developmental work on a wellbore telemetry system and, in particular, a drill pipe acoustic telemetry system. The need for means to transmit downhole data to the surface during a drilling operation is well-known in the petroleum and mining industries. In recent years, with the advent of deeper drilling operations and technical innovations which permit the detection of downhole parameters useful at the surface during the drilling operation, the need for such a telemetry system has increased.

During the course of drilling oil and gas wells, for example, there is a need for transmitting data from the bottom of the borehole to the surface without the use of electrical transmission cables. One of the most important needs for such communication is in directional drilling operations where it is helpful for the driller to know at all times the orientation of the drill in order to direct the hole in a desired direction and with a desired inclination from the vertical. Such a directional drilling system, utilizing an electrical transmission cable to transmit data to the surface, is set forth in U.S. Pat. No. 3,935,642. In such systems, rotation of the bit is typically actuated by means of a mud powered motor positioned just above the bit in the drill string. Immediately above the mud motor is a bent sub which is usually a small section of pipe having a bend of one to three degrees in its longitudinal axis. Above the bent sub is a string of drill pipe reaching to the surface which serves to support the drilling tools and to conduct a high pressure stream of drilling fluid to the downhole mud motor to power the motor and wash bit cuttings from the borehole. Downhole instruments, if used for detecting borehole parameters, are typically positioned in the drill string near the bottom of the string, and, it is desirable to transmit this information to the surface so that changes in the drilling operation may be effected in response to the measured downhole parameters. Instrumentation, for example, for sensing and transmitting the information regarding the orientation of a drill bit, such as shown in U.S. Pat. No. 3,935,643, is available commercially. However, such present commercial equipment utilizes an insulated electrical cable run inside the drill pipe as a means of supplying power to the downhole equipment and for transmitting data to the surface. The need for thousands of feet of armored electrical cable requires a large capital investment for the cable and hoisting equipment. Equally important, however, is the loss of drilling time resulting from the fact that it is necessary to withdraw the entire cable from the hole each time a joint of pipe is added to the drill string at the surface and then to replace the instrument and cable into its operating position in the pipe before drilling is resumed. The situation above described illustrates the long felt need for a wireless data transmission system. This need has led to extensive research in the area of downhole telemetry systems.

One system presently being developed is popularly referred to as a mud pulse system wherein the circulating stream of drilling fluid is modulated by pressure pulses to transmit data. The mud pulse system, however, involves complex hardware and provides a slow data rate compared to proposed acoustic drill pipe systems. Such proposed acoustic drill pipe systems are set forth in co-pending patent applications Ser. No. 390,833, entitled "Telemetry System for Boreholes" and serial number 775,620, entitled "Telemetry System". U.S. Pat. No. 3,930,220 also shows an acoustic drill pipe telemetry system. Another co-pending patent application, Ser. No. 774,432, entitled "Acoustic Transducer" shows an acoustic transducer which serves as a receiver and sound source and is adaptable to the acoustic instrument section which is disclosed schematically in the present application. The systems disclosed in the above applications and patent, involving the transmission of acoustic signals, deal primarily with the transmission of a signal through the steel body of a drill pipe string. There are problems, however, involving the transmission of acoustic signals in a pipe string. Many of these problems are set forth in the above-referenced applications and patent. For example, there are serious losses of acoustical energy due to attenuation in the drill string. Also, the elimination of electrical communication to the surface means that downhole instrumentation must be battery powered or powered by a mud generator, both of which must be of limited size in order to fit into the drill string. Therefore, it is desirable that an acoustic telemetry system utilize a sound source, a sound receiver, and other downhole equipment systems such as an instrument housing for encasing the receivers and transmitters, and, an instrument hanger for positioning the housing in the pipe string in such a manner as to provide a highly efficient coupling of the acoustic energy between the instrumentation and the steel drill pipe. Co-pending patent application, Ser. No. 774,432, entitled "Acoustic Transducer" discloses a magnetostrictive sound transducer which is adapted for use in a telemetry system, with this application setting forth in detail the problems involved in transmitting signals through a string of drill pipe and the necessity for developing as efficient a system as possible to permit the trouble free transmission of signals over a drill pipe.

One of the problems encountered in developing an acoustic telemetry system involves a sub or pipe section for hanging an acoustical instrument in the pipe string in such a way as to permit the flow of drilling fluids about the instrument and at the same time provide an efficient sound transmission path between the acoustic instruments and the pipe sub which are connected in the drill string.

The functions of an instrument sub for use in such a system are (1) to provide a structural member to connect and transmit tension and torsional forces between adjacent sections of drill pipe;

(2) to provide firm support for the instrument package;

(3) to provide ample passages for the flow of drilling fluid around the instrument assembly; and (4) to provide an efficient acoustic path for transfer of sound to and from the drilling pipe to the acoustic telemetry instrument.

A conventional instrument sub typically includes a section of pipe having an open bore in which tubular instrument seating members are positioned and connected to the interior walls of the pipe section by means of spiders, or struts, which are radially positioned at right angles between the tubular member and the interior wall of the pipe section. These struts provide for a minimum of interference of fluid flow path through the pipe section and, in addition, because they are usually welded to the tubular member and the interior of the pipe section, provide a firm support for the instrument package. The pipe section is normally threaded at its end to provide an acceptable way of transmitting tension and torsional forces between adjacent sections of the pipe string. Such a conventional instrument sub, however, does not provide an efficient acoustical path for the transfer of sound between the drill pipe and the acoustic instrument. The reason that the efficient acoustical path is not provided is that longitudinal sound waves in a pipe can pass through the arcuate walls of the pipe section between the connecting struts, in a path having a much greater area, and therefore, lower acoustical impedance than the path permitted through the struts; that is, the path from the exterior wall of the pipe section through the struts into the tubular member positioned within the pipe string for holding the acoustic instrument. Additionally, the sound transmitted through the struts is by shear forces in the strut. This produces a bending force in both the tubular seating member and the pipe wall tubes represented by the tubular seating member and the pipe wall. The tubes are much less rigid in this transverse bending direction than along their longitudinal axis. Hence, the sound energy is converted to a lateral vibration mode rather than producing vertical oscillations of the instrument and pipe.

In any event, prior art instrument housing subs are not adequate to provide a sufficient acoustical path to permit the successful operation of a downhole telemetry system. It is therefore the object of the present invention to provide a sub for housing an acoustic instrument and to provide an efficient sound path between the acoustic instrument and a pipe string in a borehole telemetry system.

SUMMARY OF THE INVENTION

With these and other objects in view, the present invention relates to the concept of an instrument hanger sub for positioning in a drill pipe string, which provides a sound path between an acoustic instrument positioned within the sub and the walls of the pipe string so that longitudinal sound waves are efficiently transmitted in a telemetry system. The hanger sub includes an interior seating member which is positioned within a section of pipe which seating member is arranged to receive an acoustic instrument in such a manner as to permit positive coupling of sound between the instrument and the seating member, with the seating member being so arranged within the pipe section that longitudinal sound waves are readily transmitted between the seating member and the exterior walls of the pipe section, which, in turn, is coupled to the string of pipe.

DESCRIPTION OF THE PREFERRED EMBODIMENTS

Figure 1:
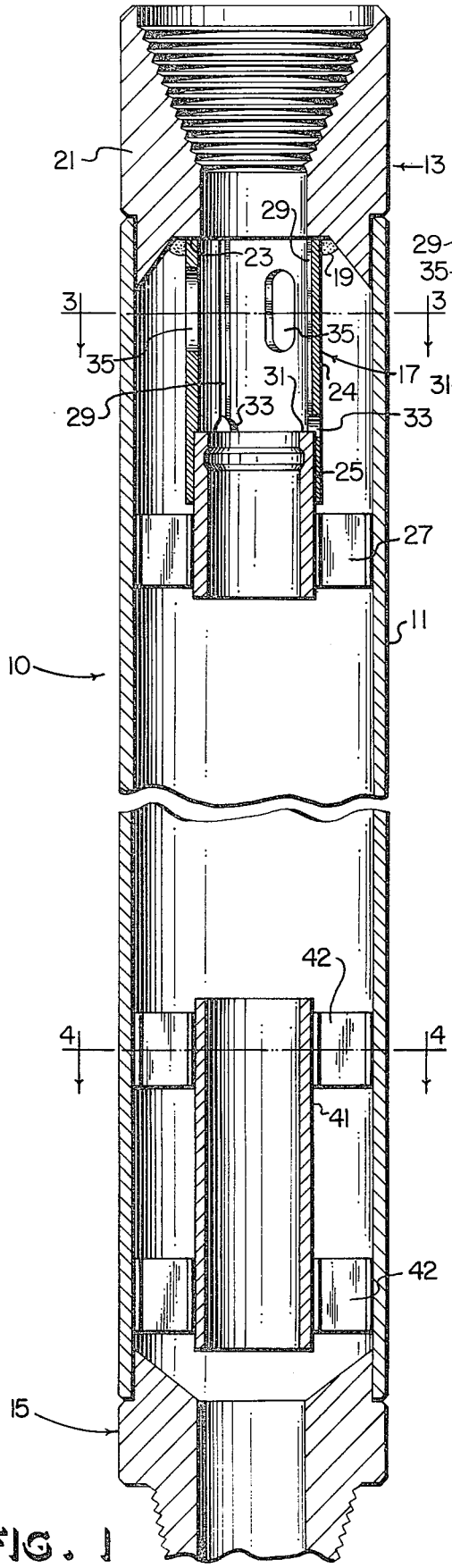
FIG. 1 is a cross-sectional, elevational view of an instrument sub in accordance with the present invention.
Figure 3:
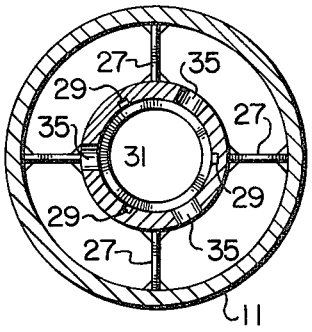
FIG. 3 is a cross-sectional view taken along lines 3-3 of FIG. 1.

Referring now to the drawings, and in particular to FIG. 1, the cross section of the instrument hanger sub shows a pipe section 10 having a wall portion 11 with a box end 13 and pin end 15 positioned at its upper and lower ends, respectively. A hanger assembly 17 is centrally positioned within the interior bore of the pipe section and is connected at its upper end by means of weld 19 to an enlarged portion 21 of the box end 13 of the sub. The enlarged portion 21 has an annular flat 23 formed at its lower end for receiving the abutting upper end of the hanger assembly 17. The hanger assembly includes an upper tubular member 24 and a lower tubular member 25 fitted within the lower end of the upper tubular member, providing an annular shoulder 31 within the interior bore of the upper tubular member 24 on the upper end of tubular member 25. The lower end of the hanger assembly 17 is centrally positioned within the pipe section 10 and is centrally maintained therein by means of struts 27 which are radially positioned between the lower tubular member 25 and the wall 11 of pipe section 10. A longitudinal slot 29 is formed within the wall of upper tubular member 24 (see also FIG. 3). The slot 29 connects the upper end of the tubular member 24 with the shoulder 31 formed by the intersection of tubular members 25 and 24. A lateral opening or port 33 is formed just above shoulder 31 through the wall of tubular member 24. Enlarged ports or slots 35 are radially positioned through the walls of upper tubular member 24 to provide a fluid flow path as will be described hereinafter.

At the lower end of pipe section 10, another tubular member 41 is positioned in the bore of the pipe and is centrally maintained therein by means of radial struts 42 positioned between the tube 41 and the wall 11 of pipe 10. This lower tubular member 41 is utilized to center the lower end of an instrument as will be described below.

Figure 4:
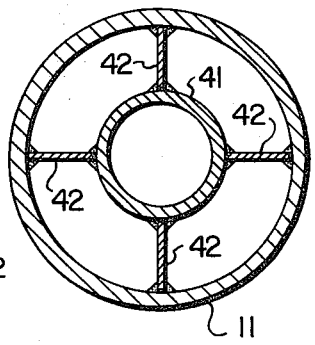
FIG. 4 is a cross-sectional view of the instrument sub taken along lines 4—4 of FIG. 1.

The configuration for mounting tube 41 in the pipe section as shown, also functions to show a typical arrangement of a prior art instrument hanger sub. Referring to the tubular member 41, as shown in FIGS. 1 and 4, it is seen that sound waves moving longitudinally through the pipe 11 would most easily flow in the arcuate wall portion 11 of the pipe located between adjacent struts 42, representing a path having a much greater area and lower acoustical impedance than the path through the struts 42. Any sound transmitted through the struts is, by vertical shear forces in the strut. This, in turn, produces a bending force in both the pipe wall 11 and tube 41. The pipe and the tube are much less rigid in this transverse bending direction than along their longitudinal axes. Hence, the sound energy travelling in the pipe wall 11 or in tubular member 41 will be converted to a lateral vibration mode rather than producing vertical or longitudinal oscillations in an instrument positioned within the tube 41, or, in the walls 11 of pipe 10.

Figure 2:
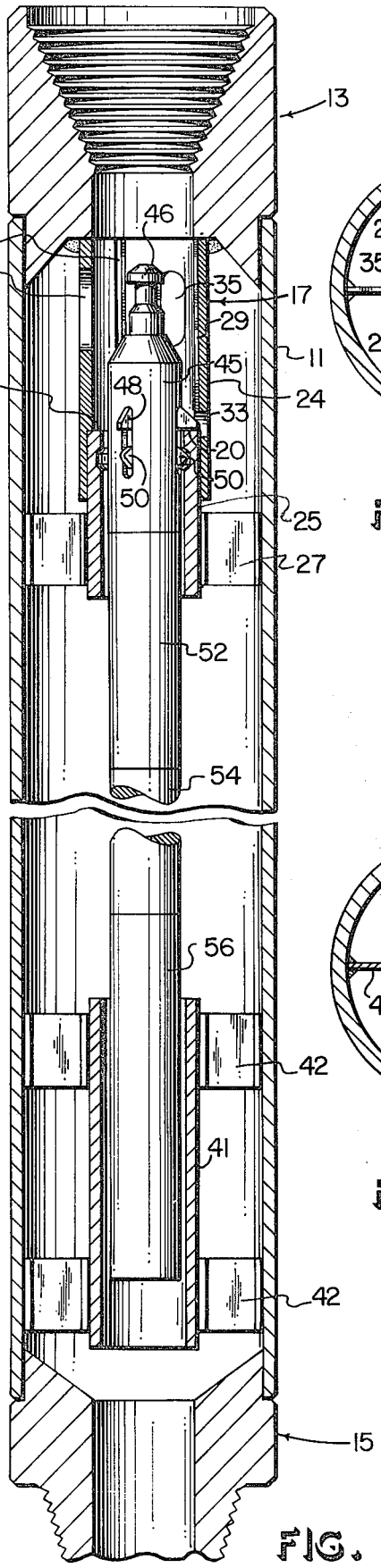
FIG. 2 is a cross-sectional, elevational view of the instrument sub of FIG. 1 and having an instrument positioned therein.

In comparison, reference is made to the hanger assembly 17 in the upper portion of the pipe section 10 of FIG. 1, keeping in mind that an instrument is positioned within the interior of the hanger 17 as shown in FIG. 2. This configuration provides a primary sound path from the drill pipe string, which is connected, at both ends of the sub 10, to the acoustic instrument by means of the pipe wall 11, then to the upper tool joint or box end 13, and downwardly through the tubular sleeve 24 to the shoulder 31 which contacts a latch assembly on the instrument as will be described later, and thence into the instrument package. The body of the tool joint 13 is so rigid that little or no shear vibrations are generated. The entire tool joint oscillates vertically in response to longitudinal waves in the pipe. Hence, sound is transmitted from the pipe 11 to the instrument by direct longitudinal motion of all members involved. In the configuration just described, there is no alternative path for sounds as in the case of lower tubular member 41 which is supported in the interior of the pipe solely by means of the struts 42. The struts 27 which are shown at the bottom of the hanger assembly 17 and on both ends of the lower sleeve 41 are mechanical attachments, only, in the present configuration.

Referring now to FIG. 2 of the drawings, an acoustical instrument is shown positioned within the hanger sub. The instrument has a fishing neck 46 at its upper end, directly connecting to a latch assembly 45, having a latch member 48 and locking dog 50. Directly connected to the bottom of the latch assembly 45 is the electronic section 52 of the acoustical instrument which houses the sound source. The sound source has a sound oscillating member abutting a plate on the lower end of the latch assembly and thereby provides a direct coupling of the sound source to the latch assembly. Battery housing 54 and 56 are positioned in the lower end of the instrument with the lower battery section 56 shown positioned within the interior of the lower tubular member 41 in order to stabilize the lower end of the instrument.

In the operation of the instrument hanger sub, an acoustical instrument as shown in FIG. 2, is positioned within the interior bore of the hanger sub 17 through its upper end with the protruding latches 48 on the latch assembly being received within the longitudinal slots 29 as the instrument is moved downwardly within the bore of tubular member 24. The latch 48 has a flat portion 20 on its lower side which abuttingly engages the annular shoulder 31 on the upper end of lower tube 25. When the instrument package is fully seated within the hanger assembly, the flat surface 20 engages the annular surface 31 to provide a direct sound coupling between the instrument package and the hanger assembly. The locking dog 50, on the latch assembly, is arranged to be received within an annular groove in the lower tubular member 35 to lock the latch assembly and attached instrument housing into firm position in the hanger assembly.

In the instance where sound waves would be travelling through the pipe section 10 and entering the hanger assembly 17 from below, the longitudinal sound waves would pass into the pipe section through the pin end 15 and into the wall 11 of pipe 10, travelling up the pipe into the box end 13 of the tool joint. These longitudinal sound waves would then be transmitted to the annular flat portion 23 on the enlarged portion 21 of the tool joint, and then into the upper end of tubular member 24. The longitudinal waves now travelling within the tube 24 are transmitted into tube 25 and thus to the upper flat end 31 of the tube 25 which, in turn, abuts the lower flat side 20 of the latch 48. All the sound waves, in the system just described, travel in a longitudinal direction to couple the sound directly to the instrument and sound transducer housed in section 52 of the instrument.

The path that is above described provides a flow for longitudinal sound waves within the system to maximize the acoustical energy transfer in an acoustic telemetry system. It is readily seen that alternative means might be utilized to provide a sound flow path comprised of longitudinal sound waves in such a system, and therefore, while the apparatus as above described provides such a system, other flow paths would provide for such an efficient transmission. Therefore, while a particular embodiment of this invention has been shown and described, it is understood that further modifications may now suggest themselves to those skilled in the art, and, it is intended to cover all such modifications as fall within the scope of the appended claims.

What is claimed is:

1. A telemetry system for transmitting acoustical signals through the pipe wall in a string of drill pipe in a borehole and having acoustic transducers in spaced positions in the string and further including, a section of pipe in the pipe string having seating means positioned therein for receiving an acoustic transducer, acoustic transducer means positioned in said pipe section for receiving acoustic signals from and sending acoustic signals to said pipe section, said seating means including a shoulder having a flat portion in a plane perpendicular to the longitudinal axis of the pipe string, said transducer means having a flat portion arranged to matingly engage the flat portion on said shoulder, and means including a longitudinal portion essentially concentric with the axis of the pipe section for providing a direct low impedance sound path between said acoustic transducer and the string of pipe to facilitate the transmission of longitudinal sound waves in the telemetry system.

2. The apparatus of claim 1 and further including additional means in said pipe section for receiving said transducer means and spaced from said seating means to align the lower end of said transducer within said pipe section.

3. The apparatus of claim 1 wherein said flat portion on said transducer is provided on a latching member.

4. The apparatus of claim 3 and further including slot means for receiving said latch member and permitting movement of said latch member to a position within said seating means where said latch member flat portion is in engagement with the flat portion on the seating means shoulder.

5. An instrument hanger for use in a borehole acoustic telemetry system including, a tubular pipe section having threaded portions at both ends for connection into a string of pipe;

a tube positioned within a bore in the pipe section and spaced from the interior walls of the pipe section, for receiving an acoustic transducer;

a transducer shoulder on the interior wall of said tubular means, and at least one longitudinal slot in the interior wall of said tube and connecting one end of said tube with the transverse shoulder.

6. The apparatus of claim 5 and further including a port in the wall of said tube for passing fluids about an acoustic transducer.

7. The apparatus of claim 5 and further including apparatus providing a low impedance sound path and connecting said tube and said tubular pipe section.

8. The apparatus of claim 6 wherein said port includes an opening through the wall of said tube and positioned above said transverse shoulder.

9. An acoustic instrument hanger sub for positioning in a pipe string for use with a borehole telemetry system comprising, a section of pipe having means at its ends for connecting the sub into the pipe string, means positioned in the interior of the pipe section and spaced from the interior walls of the pipe section for receiving an acoustic instrument, fluid flow channels formed between said receiving means and said pipe section, said receiving means having an open interior section for receiving the acoustic instrument, a transverse shoulder formed in said interior section, and means connecting said receiving means and said pipe section for providing a low impedance sound path for longitudinal sound waves.

10. The apparatus of claim 9 and further including a port in said receiving means for passing fluids about an acoustic instrument positioned in said receiving means.

11. The apparatus of claim 9 and further including an instrument stabilizer spatially positioned in said pipe section from said receiving means for receiving an end portion of an acoustical instrument.

12. An acoustic instrument hanger sub for use in a drill pipe acoustic telemetry system, comprising, a pipe section having means at its ends for connecting the pipe section into a string of pipe;

seating means connected to and centrally positioned within said pipe section for receiving an acoustic instrument, and means on said seating means for transferring longitudinal sound waves from the wall of said pipe section to an acoustic instrument positioned within said seating means.

13. An acoustic instrument housing section for use in a drill pipe acoustic telemetry system, comprising, a section of pipe having means at its ends for connecting the pipe section into a string of pipe;

means in the section of pipe for receiving an acoustic instrument, said receiving means including a longitudinal portion essentially concentric with the axis of the pipe section for providing a direct low impedance sound path between the receiving means and the wall of the string of pipe to facilitate the transmission of longitudinal sound waves in the wall of the pipe string telemetry system.

* * * * *